United States Patent [19]

Charles

[11] 4,249,861

[45] Feb. 10, 1981

[54] FAN BLADE REINFORCEMENT PLATE

[75] Inventor: Herbert N. Charles, Chatham, Canada

[73] Assignee: Canadian Fram Limited, Chatham, Canada

[21] Appl. No.: 17,673

[22] Filed: Mar. 5, 1979

[51] Int. Cl.[3] ..... F04D 29/34

[52] U.S. Cl. ..... 416/132 A; 416/210 R; 416/DIG. 3

[58] Field of Search ..... 416/132 A, DIG. 3, 210 R, 416/210 A, 214 R

[56] References Cited

U.S. PATENT DOCUMENTS

| | | | |
|---|---|---|---|
| 1,404,298 | 1/1922 | Jacobs | 416/DIG. 3 |
| 1,634,554 | 7/1927 | Pajalic | 416/DIG. 3 |
| 1,806,539 | 5/1931 | Cram | 416/DIG. 3 |
| 2,238,749 | 4/1941 | Peltier | 416/DIG. 3 |
| 3,467,419 | 9/1969 | Anderson et al. | 416/214 X |
| 3,628,888 | 12/1971 | Wooden | 416/210 |
| 3,891,349 | 6/1975 | Woollenweber | 416/210 X |
| 3,910,718 | 10/1975 | MacEwen et al. | 416/132 A |
| 4,037,987 | 7/1977 | Charles et al. | 416/132 A |
| 4,050,847 | 9/1977 | New et al. | 416/132 A |
| 4,053,260 | 10/1977 | Yee | 416/210 |
| 4,102,601 | 7/1978 | Bischoff | 416/DIG. 3 |
| 4,147,471 | 4/1979 | Charles | 416/DIG. 3 |

FOREIGN PATENT DOCUMENTS

| | | | |
|---|---|---|---|
| 1428276 | 1/1969 | Fed. Rep. of Germany | 416/214 |

*Primary Examiner*—Everette A. Powell, Jr.

*Attorney, Agent, or Firm*—Ken C. Decker; William N. Antonis

[57] ABSTRACT

A cooling fan for an automotive vehicle includes a spider having arms projecting from a hub. Rivets attach blades and reinforcing plates to each of the arms, and each of the rivets extends through the reinforcing plate, the blade, and the corresponding arm. Each blade has a depressed portion defining a rim circumscribing the depressed portion, and the corresponding plates have a depression defining a flange which is adapted to engage the rim when the blade is installed on its corresponding arm. The contour of the plate is different from the contour of the blade, but the rivet forces the plate to assume the contour of the blade when the plate and the blade are installed on the arm. Accordingly, the plate is preloaded to thereby transmit bending forces to the rim which would normally be taken by the portion of the blade adjacent the rivet.

5 Claims, 5 Drawing Figures

FAN BLADE REINFORCEMENT PLATE

BACKGROUND OF THE INVENTION

This invention relates to a cooling fan for an automotive vehicle.

Automotive vehicles have long been provided with cooling fans. These fans typically include a spider consisting of a hub from which radially extending arms project. Fan blades are normally attached to each of these arms by rivets. Unfortunately, bending forces generated in the blades during use tend to crack the blades around the rivets. The problem is particularly acute in modern vehicles, where relatively large blades are necessary to provide the necessary air flow.

Accordingly, the present invention provides a reinforcing plate which is held on the blade by the rivet that attaches the blade to the arm. The contour of the plate is different from the contour of the blade, so that a preload is established in the plate when the rivet forces the plate to assume the contour of the blade. The edge of the plate defines a flange which engages a corresponding rim on the blade, and the preload on the plate transfers the bending forces from the portion of the blade adjacent the rivet to the rim, thereby preventing cracking of the blades.

SUMMARY OF THE INVENTION

Therefore, an important object of my invention is to provide an automotive cooling fan which is more resistant to blade cracking than are cooling fans known to the prior art.

Another important object of my invention is to provide a reinforcing plate for an automotive cooling fan that is able to transmit stresses to another portion of the blade from the portion of the blade adjacent the rivets attaching the blade to the ram.

DETAILED DESCRIPTION

Figure 1:
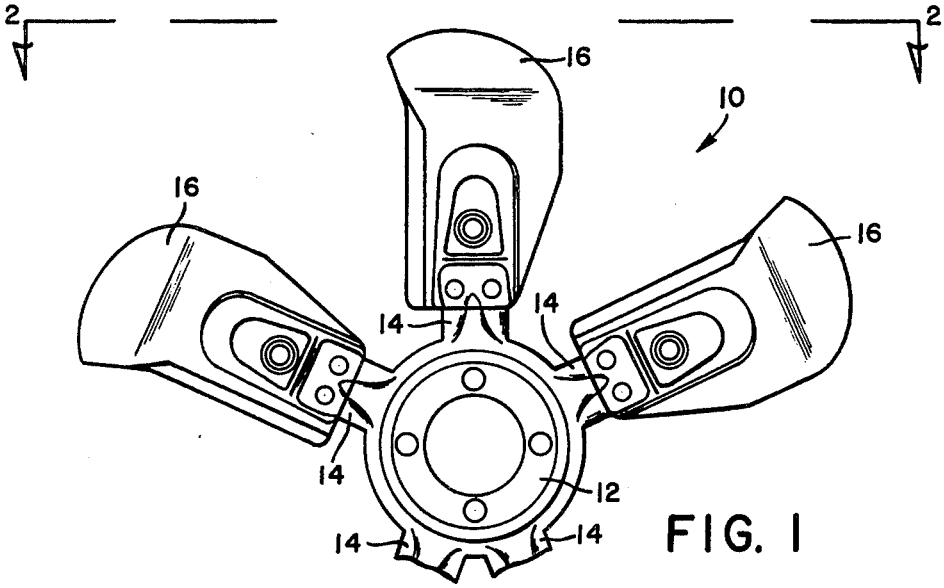
FIG. 1 is a fragmentary plan view of an engine cooling fan made pursuant to the teachings of my present invention.
Figure 2:
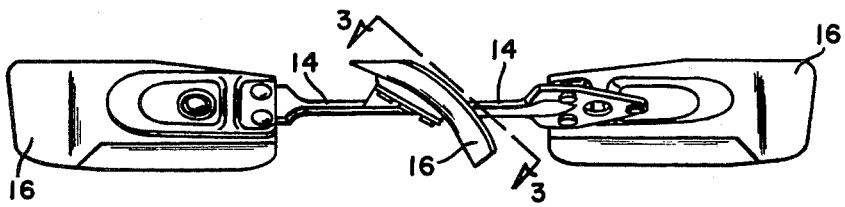
FIG. 2 is a view taken substantially along lines 2—2 of FIG. 1.
Figure 3:
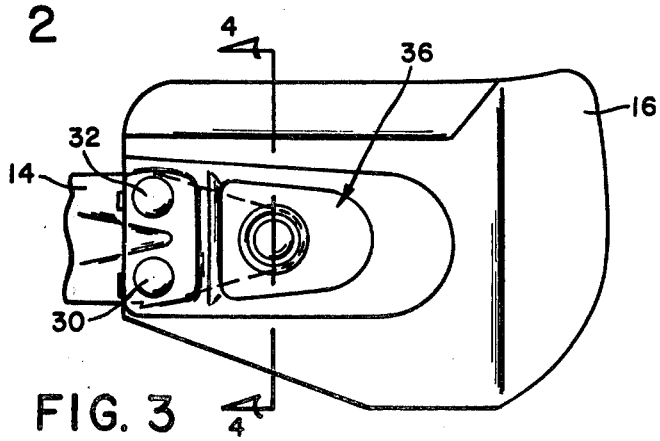
FIG. 3 is an enlarged, fragmentary view taken substantially along lines 3—3 of FIG. 2.

Referring now to the drawings, an engine cooling fan generally indicated by the numeral 10 includes a spider consisting of a hub 12 and arms 14 which extend radially from the hub 12. Blades 16 are installed on each of the arms 14. Since each of the arms 14 and blades 16 are substantially identical, only one of the arms 14 and its relationship with the corresponding blade 16 will be described in detail.

Each of the fan blades 16 includes a depressed or dished out portion 18 which includes sides 20 terminating in a rim 22. An aperture 24 is provided in the depressed portion 18 of the blade 16, and a rivet 26 extends through the aperture 24 and another aperture 28 in the arm 14 to secure the blade to the arm. Similarly, corresponding radially inner rivets 30, 32 extend through similar apertures (not shown) in the blade 16 and the arm 14 to assist in securing the blade to the arm. A raised circular rib 34 circumscribes the aperture 24 and also prevents cracking about the aperture, as more completely described in U.S. Pat. No. 4,050,847, owned by the assignee of the present invention, and incorporated herein by reference.

Figure 5:
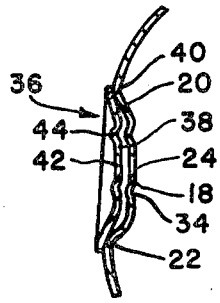
FIG. 5 is a view similar to FIG. 4 but illustrates the relationship between the blade and the reinforcing plate used in my invention before the reinforcing plate is installed on the blade and before the blade is installed on the blade arm.
Figure 4:
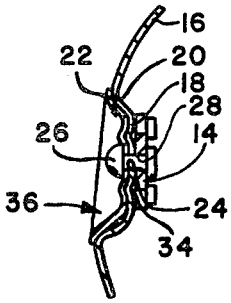
FIG. 4 is a cross-sectional view taken substantially along lines 4—4 of FIG. 3.

The present invention provides a reinforcing plate generally indicated by the numeral 36. The reinforcing plate 36 is provided with a depression 38 which terminates in a flange 40. An aperture 42 extends through the depression 38, and the rivet 26 is adapted to extend through the aperture 42 in the plate 36 and also through the aperture 24 in the blade 16, as well as the aperture 28 in the arm 14, so that the rivet 28 holds the reinforcing plate 36 and the blade 16 on the arm 14. Similarly, the rivets 30 and 32 also extend through the reinforcing plate, the blade, and the arm. It will be noted viewing FIG. 5, however, that when the plate 36 is in its relaxed or free state, the depression 38 in the reinforcing plate 36 is more shallow than is the depressed portion 18 of the blade 16. Accordingly, when the reinforcing plate is secured to the blade 16 of the arm 14 as illustrated in FIG. 4, the contour of the reinforcing plate is forced to assume the contour of the blade. Accordingly, a prestress condition is developed in the plate 36, thereby transferring forces from the depressed portion of the plate to the rim 22 through the flange 40 of the plate. The plate is also provided with a circular raised rib 44 that circumscribes the aperture 42 similar to the manner in which the rib 34 circumscribes the aperture 24. The purpose of the rib 44 is similar to the purpose of the rib 34, that is, to further prevent cracking about the rivet 26 and the apertures 42. Again, reference is made to the aforementioned U.S. Patent for a more complete description of the function of the circular ribs 44 and 34. Because of the prestressed condition of the reinforcing plate 36 when it is installed on the blade 16, bending forces which would normally flex the blade 16 about the aperture 24 and rivet 26 are transferred to the rim 22 of the blade, far away from the apertures and to a solid portion of the blade. Clearly, this solid portion of the blade 16 is more resistant to cracking than is the portion of the blade circumscribing the apertures. Of course, these bending forces occur mainly when the fan is dynamically stressed when it is in use on a vehicle.

I claim:

1. In a fan having a hub, an arm extending radially from said hub, a blade for said arm, and fastening means securing said blade to said arm, said fastening means including a rivet, said blade and said arm having aligned apertures receiving said rivet, and a reinforcing plate secured to said blade by said rivet when the blade is attached to the arm, said reinforcing plate having a free contour before installation of the plate on said blade different from the contour of the portion of the blade engaged by said plate when the plate and the blade are attached to the arm so that the plate is preloaded when it is secured to said blade, said rivet securing the plate to said blade and forcing a portion of the plate to assume the contour of said portion of the blade, said portion of the blade being depressed and cooperating with the rest of the blade to define a rim, said plate having a depression and a raised flange around at least a portion of the depression, said flange and said depression defining the free contour of the plate, said flange extending over the rim to cover the latter when the plate is installed on the blade, said rim and said depressed portion defining the free contour of said portion of the blade engaged by said plate, said rivet holding the depression on the plate against the depressed portion of the blade to force said raised flange of the plate against the rim of the blade, whereby bending forces are transferred through said plate away from said apertures.

2. The invention of claim 1:

wherein the depth of said depressed portion is greater than the depth of said depression, said rivet holding the depression against said depressed portion to thereby preload said plate to transmit bending forces from said apertures to said rim through the flange on the plate.

3. The invention of claim 2:

and a circular rib formed in said plate and circumscribing and closely adjacent to the aperture in the plate.

4. The invention of claim 2:

wherein said rivet is the radial outermost rivet securing the blade to the arm, and additional rivets are provided between the radial outermost rivet and said hub for securing said reinforcing plate and said blade to said arm.

5. The invention of claim 2:

wherein said rivet is the radial outermost rivet securing the blade to the arm and additional rivets are provided between the radial outermost rivet and said hub for securing said reinforcing plate and said blade to said arm, and a circular rib formed in said plate circumscribing and closely adjacent to said radial outermost rivet.

* * * * *